US009878339B2

(12) United States Patent
Baumann

(10) Patent No.: US 9,878,339 B2
(45) Date of Patent: Jan. 30, 2018

(54) APPLICATOR HEAD AND DISPENSER FOR A PREFERABLY PASTY MEDIUM

(71) Applicant: APTAR RADOLFZELL GMBH, Radolfzell (DE)

(72) Inventor: Tobias Baumann, Gottmadingen-Randegg (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 14/906,102

(22) PCT Filed: Jun. 23, 2014

(86) PCT No.: PCT/EP2014/063116
§ 371 (c)(1),
(2) Date: Jan. 19, 2016

(87) PCT Pub. No.: WO2015/007458
PCT Pub. Date: Jan. 22, 2015

(65) Prior Publication Data

US 2016/0158779 A1 Jun. 9, 2016

(30) Foreign Application Priority Data

Jul. 19, 2013 (DE) ..... 10 2013 214 231

(51) Int. Cl.
*B67D 7/58* (2010.01)
*B05B 11/00* (2006.01)
(Continued)

(52) U.S. Cl.
CPC ..... *B05B 11/3047* (2013.01); *A45D 34/04* (2013.01); *A45D 40/00* (2013.01);
(Continued)

(58) Field of Classification Search
CPC ..... B05B 11/3047
(Continued)

(56) References Cited

U.S. PATENT DOCUMENTS 3,361,305 A * 1/1968 Spatz ..... B05B 11/0048 222/207
4,564,130 A * 1/1986 Eulenburg ..... B05B 11/0048 222/207
(Continued)

FOREIGN PATENT DOCUMENTS

CN 102099262 A 6/2011
DE 37 38 548 A1 5/1989
(Continued)

OTHER PUBLICATIONS

International Search Report with English translation issued in Application No. PCT/EP2014/063116, dated Aug. 21, 2014 (7 pages).
(Continued)

*Primary Examiner* — Patrick M Buechner
*Assistant Examiner* — Michael J Melaragno
(74) *Attorney, Agent, or Firm* — Flynn, Thiel, Boutell & Tanis, P.C.

(57) ABSTRACT

An applicator head for discharging a pasty medium from a container, including a metering chamber, a first housing part bounding the metering chamber in sections, with an actuating element, and a second housing part. The first housing part and the second housing part form a constructional unit connectable to a container storing the medium and closing the container. By actuating the actuating element, the medium is conveyed out of the container into the metering chamber and/or is discharged from the metering chamber. A sealing element of a plastically or elastically deformable plastic is provided, and is arranged such that the container is
(Continued)

closable in a sealing manner by the constructional unit. The sealing element is manufactured as a common component with at least one further element of the applicator head.

19 Claims, 3 Drawing Sheets

(51) Int. Cl.
*A45D 34/04* (2006.01)
*A45D 40/00* (2006.01)

(52) U.S. Cl.
CPC ..... *A45D 40/0075* (2013.01); *B05B 11/0008* (2013.01); *B05B 11/0037* (2013.01); *B05B 11/0048* (2013.01); *B05B 11/3028* (2013.01); *B05B 11/3032* (2013.01); *B05B 11/3043* (2013.01); *A45D 2200/051* (2013.01); *A45D 2200/055* (2013.01)

(58) Field of Classification Search
USPC ..... 222/380, 386
See application file for complete search history.

(56) References Cited

U.S. PATENT DOCUMENTS 4,830,229 A * 5/1989 Ball ..... A47K 5/1201 222/207
4,865,230 A * 9/1989 Tugwood ..... B05B 11/0005 222/383.3
4,872,596 A * 10/1989 Corsette ..... B05B 11/0048 137/512.4
4,913,322 A 4/1990 Stoeffler et al.
8,016,165 B2 9/2011 Margheritis et al.
8,240,518 B2 8/2012 Canfield
2001/0048003 A1 12/2001 Jourdin et al.
2008/0029544 A1 2/2008 Margheritis et al.
2009/0166383 A1* 7/2009 Canfield ..... A45D 34/04 222/207
2009/0212075 A1 8/2009 Neuhaus et al.
2009/0230152 A1* 9/2009 Decottignies ..... A45D 40/0075 222/319
2009/0294480 A1 12/2009 Canfield
2009/0302064 A1* 12/2009 Lavabre ..... B05B 11/0018 222/207
2009/0314811 A1 12/2009 Dennis
2013/0008924 A1* 1/2013 Lafosse ..... B05B 11/0013 222/256
2015/0202644 A1 7/2015 Bruder et al.
2016/0158779 A1* 6/2016 Baumann ..... A45D 34/04 222/380

FOREIGN PATENT DOCUMENTS

DE 20 2006 010 319 U1 10/2006
EP 0 363 307 A1 4/1990
WO WO 2007/131790 A2 11/2007
WO WO 2010/131042 A1 11/2010
WO WO 2014/029568 A1 2/2014

OTHER PUBLICATIONS

Second Office Action, with English translation, issued in Chinese Appln. No. 201480051612.1, dated Aug. 14, 2017 (17 pages).

* cited by examiner

APPLICATOR HEAD AND DISPENSER FOR A PREFERABLY PASTY MEDIUM

FIELD OF USE AND PRIOR ART

The invention relates to an applicator head for discharging a preferably pasty medium from a container, comprising a metering chamber, a first housing part bounding the metering chamber in sections, with an actuating element, and a second housing part, wherein the first housing part and the second housing part form a constructional unit which is connectable to a container storing the medium and closes the container.

Viscous or creamy liquids, suspensions and/or fluids, water-in-oil emulsions (W/O emulsions), oil-in-water emulsions (O/W emulsions), oleo gels, hydro gels or the like are referred to as pasty media within the context of the application. In particular, cosmetic media, such as skincare agents, lotions, hair gels, wash gels or the like, are involved here.

Media of this type are preferably stored in boxes or pots which permit easy and complete removal with a finger or spatula. In conjunction with the application, containers which have a small overall height in comparison to the diameter thereof are designated a pot or box.

However, open pots are not suitable for volatile components, water-containing preparations or products with a low concentration of preservatives. In particular, the intention is to store high-quality media in the pot preferably without contact with the atmosphere. It is therefore known to provide an applicator head on the pot, by means of which removal portion by portion without contact with the stored product is possible.

An applicator head of this type is known, for example, from WO 2007/131790 A2, wherein the applicator head is screwable to the container or is connectable thereto by means of latches. Furthermore, a connection by means of adhesive bonding or welding is known from the document.

A box which is designed as a dispenser for pasty products is furthermore known from EP 0 363 307 A1, wherein the box has a cover which is preferably connected nondetachably to the box wall or is formed in one part therewith and which has an outlet opening and closes the box in the direction of the applicator head.

DE 37 38 548 A1 discloses a constructional unit which is latchable to a container, comprising an insert, a bellows which is connected to the insert in order to form a metering chamber, and an actuating handle acting on the bellows.

It is an object of the invention to provide an applicator head by means of which a container is closable at least substantially in an air-tight manner, wherein a connection can be produced cost-effectively and in as automated a manner as possible.

According to a first aspect of the invention, an applicator head for discharging a medium, preferably a pasty medium, from a container is provided, comprising a metering chamber, a first housing part bounding the metering chamber in sections, with an actuating element, and a second housing part, wherein the first housing part and the second housing part form a constructional unit which is connectable to a container storing the medium and closes the container, wherein, by actuation of the actuating element, the medium can be conveyed out of the container into the metering chamber and/or can be discharged from the metering chamber, and wherein a sealing element composed of a plastically or elastically deformable plastic is provided, said sealing element being arranged in such a manner that the container is closable in a sealing manner by means of the constructional unit, and said sealing element being manufactured as a common component with at least one further element of the applicator head.

By means of the integral design of the sealing element with at least one further element of the applicator head, it is ensured that the sealing element is fitted without error during installation. The sealing element is composed of an elastically and/or plastically deformable material which fits closely against a corresponding geometry on the container.

The applicator head is connected to the container, which is preferably designed as a box or pot. A metered application of the medium stored in the container is possible by means of the applicator head.

For the connection to the container, the first housing part and/or the second housing part have/has a suitable connecting structure, in particular latching elements for a snap connection.

In a refinement, the second housing part and the sealing element are manufactured as an integral injection molded part composed of at least two plastics of different properties, wherein the housing part is composed of the first of the two plastics, and the sealing element is composed of the second of the two plastics.

Alternatively or additionally, in another refinement, an inlet valve which is assigned to the metering chamber is provided, wherein, by resetting the actuating element, a negative pressure can be generated in the metering chamber and, owing to a negative pressure in the metering chamber, a medium can be conveyed via the inlet valve into the metering chamber, and wherein the sealing element and the inlet valve are manufactured as a common component composed of an elastically deformable plastic.

In other words, it is alternatively or additionally provided that the sealing element and the inlet valve are designed as a common component. It is in particular useful here that, in advantageous refinements, given an appropriate configuration of the inlet valve and the sealing element, plastics having the same properties are advantageous; in particular, elastic plastics, such as thermoplastic elastomers (TPE), are suitable here.

In advantageous refinements, it is provided that the second housing part, the sealing element and the inlet valve are manufactured as an integral injection molded part composed of at least two plastics of different properties, wherein the housing part is composed of the first of the two plastics, and the sealing element and the inlet valve are composed of the second of the two plastics. The sealing element and the inlet valve are preferably composed of TPE, as mentioned above. The second housing part is preferably composed of a stiffer plastic, i.e. a plastic having a higher modulus of elasticity than TPE. In particular if a connecting structure designed as a latching structure is provided on the second housing part for the connection to the container, greater dimensional stability is required for the second housing part. In advantageous refinements, the second housing part is composed of a harder plastic, in particular of polypropylene or HDPE (high density polyethylene).

By means of the integral design of the sealing element with the housing part and/or the inlet valve, it is possible to provide an applicator head which has a small number of parts to be fitted individually and can be attached in a sealing manner to a container.

The metering chamber is preferably furthermore assigned an outlet valve. In one refinement, a negative pressure for sucking the medium into the metering chamber can be generated by means of the actuating element, wherein the medium is discharged from the metering chamber directly after an actuating force ceases. It is preferably provided that the medium can be discharged from the metering chamber via the outlet valve by actuation of the actuating element, a negative pressure can be generated in the metering chamber by resetting the actuating element and, owing to a negative pressure in the metering chamber, a medium can be conveyed via the inlet valve into the metering chamber. In other words, a peristaltic pumping system is provided, which is distinguished by the small number of components and the reliable handlability.

In an advantageous refinement, the inlet valve and/or the outlet valve are/is designed as a slot valve. In the context of the invention, a slit membrane element which is arranged over an opening and, when an opening pressure or a negative pressure is applied, opens in a discharge direction, but closes the opening counter to the discharge direction, is referred to as a slot valve. Elastic plastics, such as TPE, are suitable for slot valves of this type.

In one refinement, a piston or the like which is adjustable counter to a force of a resetting spring is provided as the actuating element. In an advantageous refinement, the actuating element is designed as an elastic actuating element which is actuable by reverse deformation.

It is provided here, in one refinement, that the actuating element and the outlet valve assigned to the metering chamber are manufactured as a common component.

In advantageous refinements, the first housing part and the actuating element and/or the first housing part and the outlet valve are manufactured as an integral component, in particular as an integral injection molded part composed of at least two plastics of different properties, wherein the first housing part is composed of the first of the two plastics, and the actuating element and/or the outlet valve are/is composed of the second of the two plastics. The housing part here is preferably manufactured from a plastic which imparts sufficient rigidity to the component and has a comparatively high modulus of elasticity. Suitable plastics are, for example, polypropylene or HDPE. The actuating element and the outlet valve are preferably composed of a common, second plastic. A plastic which permits reversible deformation for opening the outlet valve and/or resetting of the actuating element when an actuating force ceases is provided here. In particular, the actuating element and/or the outlet valve are/is preferably composed of TPE.

In advantageous refinements, the applicator head therefore comprises only two components. A particularly simple and preferably automated installation is thereby possible.

In advantageous refinements, it is provided that the first housing part has a dispensing surface on an outer wall, with respect to which the outlet valve opens. A metered medium conveyed out of the metering chamber is discharged onto the dispensing surface and can be removed by the user from the dispensing surface with the finger, with a spatula or with a pad of cotton wool. It is possible here for the user to remove the metered medium portion by portion, wherein a feel is provided similar to removal with the finger directly from a pot. At the same time, it is prevented that the medium stored in the container dries out or decomposes because of contact with the atmosphere.

In an advantageous refinement, a dispensing direction of the medium from the metering chamber encloses an angle with the vertical and horizontal in the use state. In other words, the medium is dispensed at an angle, wherein the outlet valve is preferably provided on an edge of the dispensing surface. By means of the oblique dispensing of the medium, it is prevented that the medium collects on the outlet valve. At the same time, safe dispensing of the medium onto the dispensing surface is possible.

In one refinement, an intermediate element which bounds the metering chamber in sections is arranged between the first housing part and the second housing part. Shape and size of the intermediate element are adapted here to a desired metering volume. In one refinement, the intermediate element is connected, in particular permanently connected, for example adhesively bonded or welded, to the first housing part, wherein the metering chamber is formed between the first housing part and the second housing part.

In an alternative refinement, it is provided that, in order to form the metering chamber, a volume of an intermediate space between the first housing part is bounded by a web, which is arranged on the first housing part and/or on the second housing part, and a sealing surface interacting with the web. As a result, it is possible to provide a metering chamber with a desired metering volume without additional elements, wherein the applicator head can be placed onto a container having a large diameter—in relation to the overall height thereof. In advantageous refinements, in the case of an applicator head of this type, the second housing part and/or an inlet valve of the metering chamber are/is also designed as a common component with a sealing element, for sealing the applicator head in relation to the container.

According to a further aspect, a dispenser is provided for a preferably pasty medium, comprising a container for storing a medium and an applicator head, which is connected to the container. The container is preferably designed as a pot or box having a small overall height in comparison to the diameter thereof. In advantageous refinements, for example, an overall height of approx. 35 mm to approx. 55 mm, in particular approx. 50 mm, and a diameter of approx. 55 mm to approx. 100 mm, in particular approx. 70 mm, are provided. In advantageous refinements, the container has a circular area. The container is in multiple parts in one refinement, comprising a stable outer container and a bag which is arranged therein, stores the medium to be dispensed and collapses when the medium is removed. In other refinements, a dragging piston is provided in the container. In one refinement, the container is likewise in two parts, comprising an inner container, which directly stores the medium, and an outer wall. A two-part configuration is of advantage in particular in the sphere of high-quality cosmetics, wherein an outer wall can be designed according to aesthetic aspects, while an inner wall can be designed according to functional aspects. In one refinement, the outer container and/or the outer wall are of conical design at least in sections.

BRIEF DESCRIPTION OF THE DRAWINGS

Further aspects and advantages of the invention emerge from the claims and from the descriptions below of preferred exemplary embodiments of the invention, which are explained with reference to the figures, in which:

DETAILED DESCRIPTION OF THE EXEMPLARY EMBODIMENTS

Figure 1:
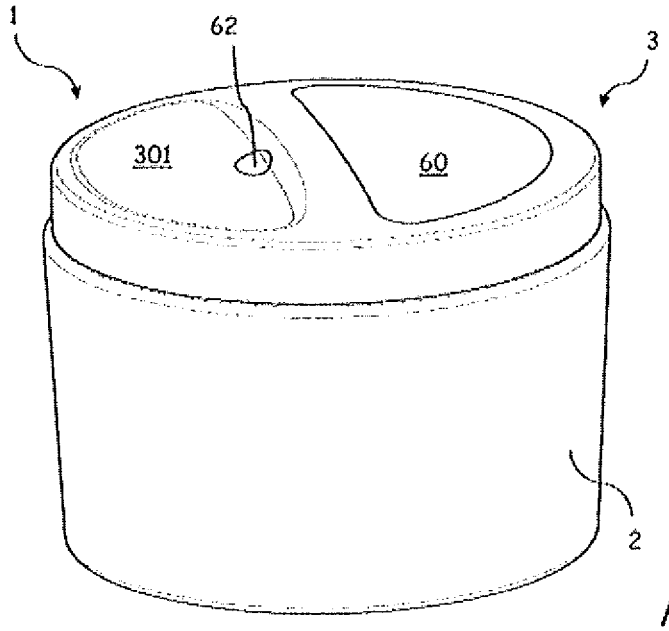
FIG. 1 shows a first embodiment of a dispenser according to the invention in a perspective illustration.
Figure 2:
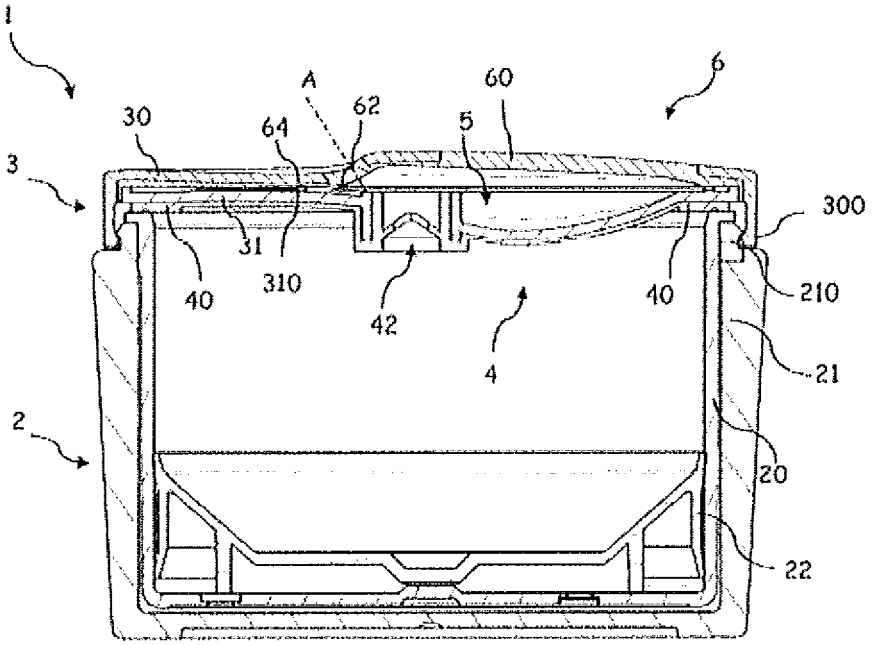
FIG. 2 shows a sectional illustration of the dispenser according to FIG. 1.
Figure 3:
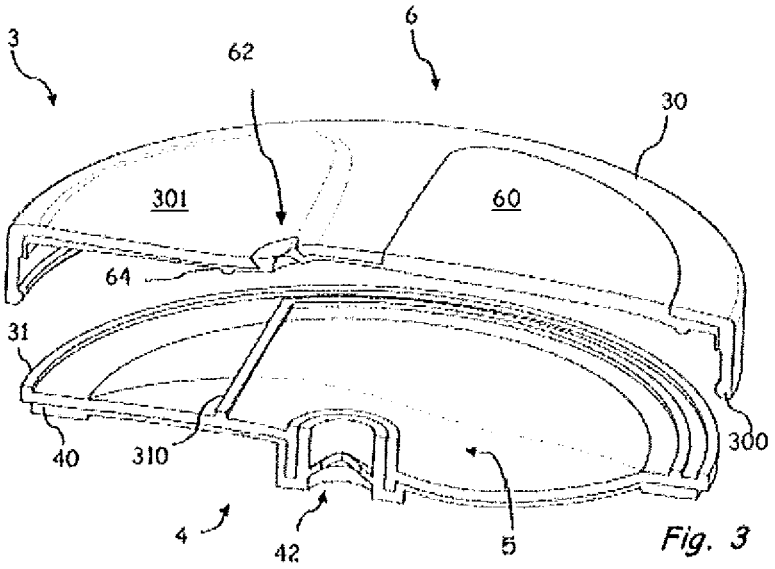
FIG. 3 shows a sectional exploded illustration of an applicator head for a dispenser according to FIG. 1.

FIGS. 1 and 2 schematically show a first embodiment of a dispenser 1 for a pasty medium, comprising a container 2 for storing the medium and an applicator head 3, which is connected to the container 2, for discharging the medium, in a perspective illustration and in a sectional view, respectively. FIG. 3 shows schematically the applicator head 3 in a sectional exploded illustration.

The container 2 is designed as a pot or box and is suitable for receiving and storing a pasty medium, for example a cream. In the exemplary embodiment illustrated, the container 2 is in two parts, comprising an inner container 20, in which the medium is accommodated, and an outer container 21. The inner container 20 contains a dragging piston 22 which is moved in the direction of the applicator head 3 on account of a negative pressure arising because of consumption of the medium, in order thereby to ensure pressure equalization in the container 2.

The applicator head 3 comprises a first housing part 30 and a second housing part 31, which form a constructional unit by means of which the container 2 is closable. For this purpose, in the exemplary embodiment illustrated in FIGS. 1 to 3, the outer container 21 and the first housing part 30 have complementary latching elements 210, 300.

A sealing element 40 is provided between the container 2 and the applicator head 3, by means of which sealing element the constructional unit, i.e. the applicator head 3, is connectable in a sealing manner to the container 2 such that the container 2 is closable in a sealing manner by means of the applicator head 3. The sealing element 40 and the second housing part 31 are manufactured as an integral injection molded part composed of two plastics of different properties, wherein the sealing element 40 is manufactured from a plastic having greater plastic and/or elastic deformability than the second housing part 31.

The first housing part 30 and the second housing part 31 bound a metering chamber 5, wherein the metering chamber 5 is assigned an inlet valve 42 and an outlet valve 62. An actuating element 60 is provided on the first housing part 30. In the exemplary embodiments illustrated, the actuating element 60 is designed as an elastic actuating element which is actuable by reverse deformation. This creates a peristaltic pumping system, wherein a medium can be discharged from the metering chamber 5 via the outlet valve 62 by actuation of the actuating element 60 and an associated reduction in a volume of the metering chamber 5. When an actuating force acting on the actuating element 60 ceases, the actuating element 60 is returned into the non-deflected state illustrated, wherein a negative pressure is produced in the metering chamber 5 by resetting the actuating element 60. Owing to the negative pressure, the medium is conveyed out of the container 2 into the metering chamber 5 by the inlet valve 42.

In the exemplary embodiment illustrated, the inlet valve 42 and the outlet valve 62 are each designed as slot valves. The inlet valve 42 and the sealing element 40 are manufactured as a common component 4 and jointly in one part with the second housing part 31. The outlet valve 62 and the elastic actuating element 60 are likewise manufactured as a common component 6 and preferably as an integral injection molded part together with the first housing part 30. As a result, an applicator head is created with a very small number of components.

In the exemplary embodiment illustrated, a dispensing surface 301, toward which the outlet valve 62 opens, is provided on the first housing part 30. In the exemplary embodiment illustrated, the actuating element 60 and the dispensing surface 301 are dimensioned in such a manner that they both take up approximately half of a surface of the first housing part 30. However, these dimensions are merely by way of example. Suitable dimensions can be adapted to aesthetic requirements, a desired metering volume or the like. In the exemplary embodiment illustrated, the dispensing surface 301 is designed as a trough-shaped depression on an outer wall of the first housing part 30. This provides a good feel for the user for removing the medium. The outlet valve 62 is arranged on an edge of the dispensing surface 301. The dispensing direction A is directed obliquely upward in order to prevent the medium from accumulating at the outlet valve 62.

In order to reduce a dead volume of the metering chamber, in the exemplary embodiment illustrated a volume of an intermediate space between the first housing part 30 and the second housing part 31 is bounded by a web 310, which is arranged on the second housing part 31. The web 310 protrudes from the second housing part 31 in the direction of the first housing part 30 and interacts with a sealing surface 64. In the exemplary embodiment illustrated, the sealing surface 64 is realized as a portion of a common component 6 with the actuating element 60 and the outlet valve 62. Additional components are thereby dispensed with.

In the exemplary embodiment illustrated, the outlet valve 62, the actuating element 60 and the sealing surface 64 are designed as a common component 6. A closed surface, which faces the medium, is also provided here on the metering chamber 5, and therefore gaps or the like in which a medium may accumulate are avoided. At the same time, the number of components is kept small.

The first component 30 and the second component 31 are interconnected to each other here indirectly by the coupling to the container 2.

Figure 4:
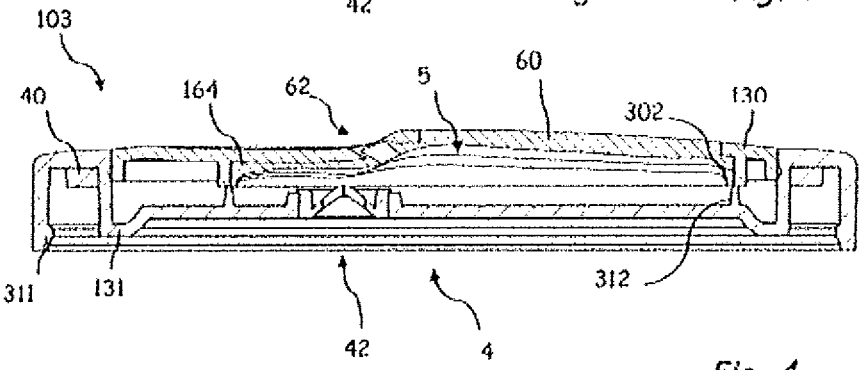
FIG. 4 shows a second embodiment of an applicator head according to the invention in a sectional illustration.
Figure 5:
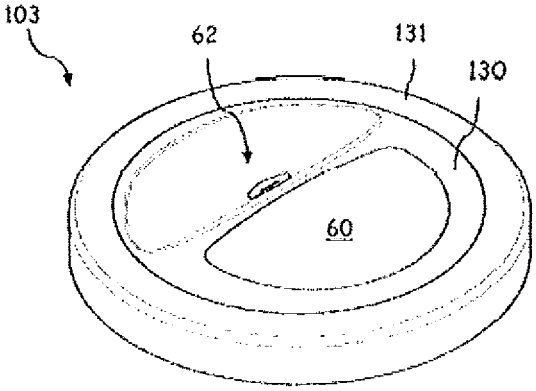
FIG. 5 shows the second embodiment of an applicator head according to the invention in a perspective illustration.

FIGS. 4 and 5 show a second embodiment of an applicator head 103 in a sectional illustration and a perspective illustration. The applicator head 103 is used in a similar manner to the applicator head 3 according to FIGS. 1 to 3 and uniform reference signs are used for identical or similar components. Components which have already been described are not described again. The applicator head 103 likewise comprises a first housing part 130 with an actuating element 60, and a second housing part 131, wherein the first housing part 130 and the second housing part 131 bound a metering chamber 5. In contrast to the exemplary embodiment according to FIGS. 1 to 3, in the exemplary embodiment according to FIGS. 4 and 5 a connecting structure 311 for connecting the applicator head 103 to the container 2 illustrated in FIG. 1 is arranged on the second housing part 131. For this purpose, in the exemplary embodiment illustrated, an encircling latching groove is provided in which the sealing element 40 is arranged and into which an edge of the container 2 can be inserted.

The first component 130 and the second component 131 are latched to each other here in order to form the constructional unit, wherein the first component 130 is inserted into a receptacle, which is formed by webs of the latching groove, in the second component 131, with an intermediate space being formed. Also in the embodiment according to FIGS. 4 and 5, a region, acting as metering chamber 5, of the intermediate space between the first housing part 130 and the second housing part 131 is bounded by webs 302, 312 protruding from the housing parts and by a sealing surface 164. In one refinement, the first and the second components 130, 131 are additionally permanently connected to each other, for example are adhesively bonded or welded to the webs 302, 312.

Figure 6:
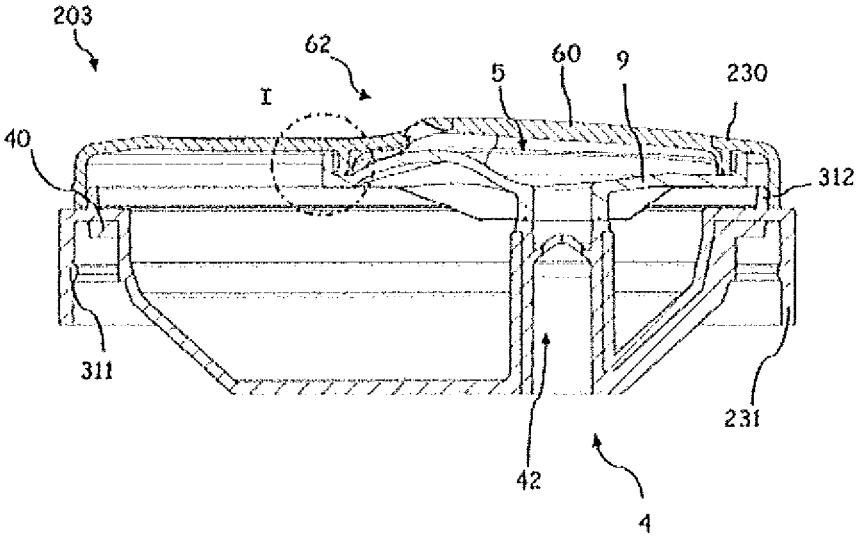
FIG. 6 shows a third embodiment of an applicator head according to the invention in a sectional illustration.
Figure 7:
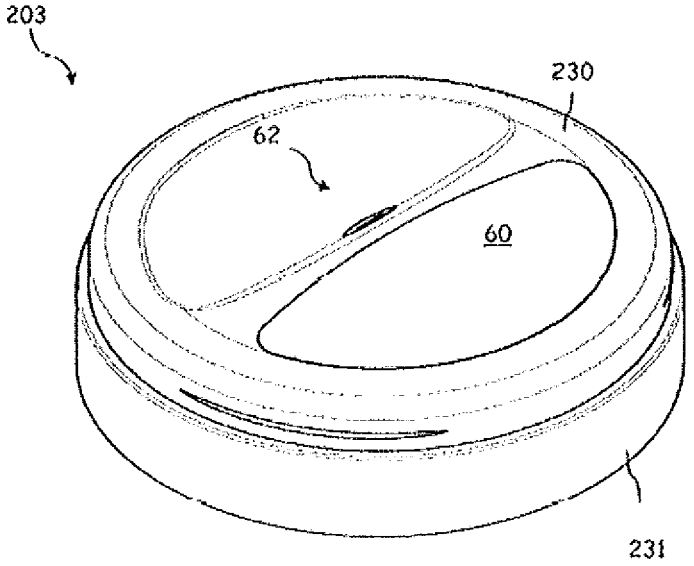
FIG. 7 shows the third embodiment of an applicator head according to the invention in a perspective illustration.

FIGS. 6 and 7 show a further exemplary embodiment of an applicator head 203 comprising a first housing part 230 and a second housing part 231, which forms a constructional unit therewith, wherein an intermediate element 9 is arranged between the first housing part 230 and the second housing part 231. In the exemplary embodiment illustrated in FIGS. 6 and 7, a connecting structure 311 for the coupling to the container 2 according to FIGS. 1 and 2 is provided on the second housing part 231. In this refinement, the metering chamber 5 is bounded by the first housing part 230 with the actuating element 60, and by the intermediate element 9. An inlet valve 42 is provided on the second housing part 231 and, together with a sealing element 40 with respect to the container, is designed as a single-part component 4.

In the refinement illustrated, the intermediate part 9 is fixedly connected, in particular welded, to the first component 230 at a welding point T. The first component and the second component are likewise connected to each other, in particular latched to each other, in order to form the constructional unit. In the exemplary embodiment illustrated, it is provided that the first component 230 is placed in the manner of a cover onto an encircling edge 312 and latched at the edge 312 to the second component 231.

The invention claimed is:

1. A dispenser comprising:

a container for storing a medium; and an applicator head connected to the container;

the applicator head comprising:

a metering chamber;

a first housing part bounding the metering chamber in sections, with an actuating element; and a second housing part;

wherein the first housing part and the second housing part form a constructional unit which is connectable to the container and closes the container;

wherein, by actuation of the actuating element, the medium can be conveyed out of the container into the metering chamber and/or can be discharged from the metering chamber;

the dispenser further including a sealing element arranged in such a manner that the container is closable in a sealing manner by the constructional unit, with the sealing element forming a static seal between the applicator head and the container, the sealing element further being clamped between and by the applicator head and the container;

wherein the sealing element is manufactured as a common component with at least one further element of the applicator head;

the dispenser further including an inlet valve assigned to the metering chamber, wherein, by resetting the actuating element, a negative pressure can be generated in the metering chamber and, owing to a negative pressure in the metering chamber, the medium can be conveyed via the inlet valve into the metering chamber, and wherein the sealing element and the inlet valve are manufactured as a common component composed of an elastically deformable plastic; and an outlet valve assigned to the metering chamber, wherein the medium can be discharged from the metering chamber via the outlet valve by actuation of the actuating element; and wherein the first housing part has a dispensing surface on an outer wall, with respect to which the outlet valve opens, the dispensing surface being designed as a trough-shaped depression.

2. The dispenser as claimed in claim 1, wherein the second housing part and the sealing element are manufactured as an integral injection molded part composed of at least two plastics of different properties, wherein the second housing part is composed of a first one of the at least two plastics and the sealing element is composed of a second one of the at least two plastics.

3. The dispenser as claimed in claim 1, wherein the outlet valve and/or the inlet valve are/is designed as a slot valve.

4. The dispenser as claimed in claim 1, wherein the actuating element is designed as an elastic actuating element which is actuable by reverse deformation.

5. The dispenser as claimed in claim 4, wherein the actuating element and the outlet valve are manufactured as a common component.

6. The dispenser as claimed in claim 4, wherein the first housing part and the actuating element and/or the first housing part and the outlet valve are manufactured as an integral injection molded part composed of at least two plastics of different properties, wherein the first housing part is composed of a first one of the at least two plastics, and the actuating element and/or the outlet valve are/is composed of a second one of the at least two plastics.

7. The dispenser as claimed in claim 1, wherein a dispensing direction of the medium from the metering chamber encloses an angle with a vertical and a horizontal in a use state.

8. The dispenser as claimed in claim 1, wherein an intermediate element which bounds the metering chamber in sections is arranged between the first housing part and the second housing part.

9. The dispenser as claimed in claim 1, wherein the metering chamber is bounded by the first housing part comprising the actuating element and the second housing part, wherein, in order to form the metering chamber, a volume of an intermediate space between the first housing part and the second housing part is bounded by a web, which is arranged on the first housing part and/or the second housing part, and a sealing surface.

10. A dispenser comprising:

a container for storing a medium; and an applicator head connected to the container;

the applicator head including a first housing part and a second housing part defining a metering chamber therebetween, the first housing part including an actuating element;

the applicator head being connectable to the container and closing the container;

wherein the medium is at least one of conveyed out of the container, conveyed into the metering chamber and discharged from the metering chamber by actuation of the actuating element;

the applicator head further including a sealing element forming a static seal between the applicator head and the container, the sealing element further being clamped between and by the applicator head and the container;

the applicator head further including an inlet valve for the metering chamber, wherein, by resetting the actuating element, a negative pressure is generated in the metering chamber and, owing to a negative pressure in the metering chamber, the medium can be conveyed via the inlet valve into the metering chamber;

the sealing element and the inlet valve are manufactured as a common component composed of an elastically deformable plastic; and the applicator head further including an outlet valve assigned to the metering chamber, wherein the medium can be discharged from the metering chamber via the outlet valve by actuation of the actuating element; and wherein the first housing part has a dispensing surface on an outer wall thereof, with respect to which the outlet valve opens, the dispensing surface being a trough-shaped depression in the outer wall.

11. The dispenser as claimed in claim 10, wherein the second housing part and the sealing element are integral and composed of at least two plastics of different properties, wherein the second housing part is composed of a first one of the at least two plastics and the sealing element is composed of a second one of the at least two plastics.

12. The dispenser as claimed in claim 10, wherein the outlet valve and/or the inlet valve comprise a slot valve.

13. The dispenser as claimed in claim 10, wherein the actuating element is elastic and actuable by reverse deformation.

14. The dispenser as claimed in claim 13, wherein the actuating element and the outlet valve are manufactured as a common component.

15. The dispenser as claimed in claim 13, wherein the first housing part and the actuating element and/or the first housing part and the outlet valve are integral and composed of at least two plastics of different properties, wherein the first housing part is composed of a first one of the at least two plastics, and the actuating element and/or the outlet valve is composed of a second one of the at least two plastics.

16. The dispenser as claimed in claim 10, wherein an intermediate element which bounds the metering chamber in sections is arranged between the first housing part and the second housing part.

17. The dispenser as claimed in claim 10, wherein the metering chamber is bounded by the first housing part comprising the actuating element and the second housing part, wherein, in order to form the metering chamber, a volume of an intermediate space between the first housing part and the second housing part is bounded by a web, which is arranged on the first housing part and/or the second housing part, and a sealing surface.

18. The dispenser as claimed in claim 10, wherein the sealing element contacts both the applicator head and the container.

19. The dispenser as claimed in claim 1, wherein the sealing element contacts both the applicator head and the container.

* * * * *